US007963138B2

(12) United States Patent
Okada et al.

(10) Patent No.: US 7,963,138 B2
(45) Date of Patent: Jun. 21, 2011

(54) METHOD AND APPARATUS FOR FORMING A CHANGED DIAMETER PORTION OF A WORKPIECE

(75) Inventors: Hitoshi Okada, Nishikamo-gun Aichi (JP); Tohru Irie, Nishikamo-gun Aichi (JP)

(73) Assignee: Sango Co., Ltd., Nishikamo-gun (JP)

( * ) Notice: Subject to any disclaimer, the term of this patent is extended or adjusted under 35 U.S.C. 154(b) by 788 days.

(21) Appl. No.: 11/793,475

(22) PCT Filed: Dec. 9, 2005

(86) PCT No.: PCT/JP2005/022669

§ 371 (c)(1),
(2), (4) Date: Jun. 20, 2007

(87) PCT Pub. No.: WO2006/070584

PCT Pub. Date: Jul. 6, 2006

(65) Prior Publication Data

US 2008/0127699 A1 Jun. 5, 2008

(30) Foreign Application Priority Data

Dec. 27, 2004 (JP) ..... 2004-375943

(51) Int. Cl.
*B21D 22/00* (2006.01)
*B21D 3/02* (2006.01)
*B21B 15/00* (2006.01)

(52) U.S. Cl. ..... 72/84; 72/125; 72/121

(58) Field of Classification Search ..... 72/82–85, 72/120–121, 370.1, 370.24, 370.25, 125
See application file for complete search history.

(56) References Cited

U.S. PATENT DOCUMENTS 6,018,972 A 2/2000 Irie
6,216,512 B1 4/2001 Irie
6,233,993 B1 5/2001 Irie
6,834,245 B2 12/2004 Ota et al.

FOREIGN PATENT DOCUMENTS

EP 0 916 426 A1 5/1999

(Continued)

OTHER PUBLICATIONS

European Search Report for Application No. 05814175.5; mailed Mar. 5, 2010.

(Continued)

*Primary Examiner* — Edward Tolan
*Assistant Examiner* — Mohammad Yusuf
(74) *Attorney, Agent, or Firm* — Oliff & Berridge, PLC

(57) ABSTRACT

A plurality of intermediate cross sections and center points thereof are provided for a plurality of target processed portions from an unprocessed portion of a workpiece up to a final target processed portion. By adjusting a relative position between each intermediate cross section of the workpiece W and rollers 11, 12 revolving around the workpiece between neighboring intermediate cross sections, adjusting a revolution diameter of the roller and an angle of its revolution plane, mating the center point, diameter and inclined angle of the revolution plane inside of a revolving locus of the roller, with the center point, diameter and inclined angle of each intermediate cross section of the workpiece, and driving the roller and workpiece relatively to each other, with a part of outer peripheral surface of the roller being always in contact with an outer peripheral surface of the workpiece, a spinning process is performed to change the diameter of the portion to be processed of the workpiece.

13 Claims, 9 Drawing Sheets

FOREIGN PATENT DOCUMENTS

| | | | |
|---|---|---|---|
| EP | 0 916 428 | A2 | 5/1999 |
| EP | 1 053 799 | A2 | 11/2000 |
| EP | 1 302 253 | A2 | 4/2003 |
| EP | 1 482 140 | A1 | 12/2004 |
| JP | A 2000-094069 | | 4/2000 |
| JP | A-2000-190030 | | 7/2000 |
| JP | A-2000-190038 | | 7/2000 |
| JP | A 2001-025826 | | 1/2001 |
| JP | A 2001-107725 | | 4/2001 |
| JP | A 2001-344009 | | 12/2001 |
| JP | B2 3390725 | | 1/2003 |
| JP | A 2004-202531 | | 7/2004 |

OTHER PUBLICATIONS

Office Action issued in European Patent Application No. 05814175.5 on Sep. 2, 2010.

Office Action issued in Japanese Patent Application No. 2004-375943 on Nov. 24, 2010 (w/English Translation).

METHOD AND APPARATUS FOR FORMING A CHANGED DIAMETER PORTION OF A WORKPIECE

FIELD OF THE INVENTION

The present invention relates to a method and an apparatus for forming a changed diameter portion of a workpiece, and relates to the method and apparatus for forming a reduced diameter portion integrally on an end portion of a metallic tubular member like a cylinder, for example.

BACKGROUND ART

With respect to a method for forming a reduced diameter portion on an end portion of a metallic tubular member like a cylinder (hereinafter called as tubular member), in Patent document 1 for example, there is disclosed a method for forming a reduced diameter portion in any one of an offset, oblique or skewed relationships to a central axis of the tubular member by a spinning process. This is a sequential process for providing a desired shape by a plurality of cycles (a plurality of paths) of the spinning process. It is described that in the case where an oblique portion or a skewed portion (=nonparallel portion), the spinning process is achieved by providing a forming target axis for each path, holding a workpiece to mate the forming target axis with a revolution center (movable) axis of a roller, and the revolution center moving along the revolution axis with a revolution diameter of the roller being adjusted, whereby a desired oblique or skewed shape can be provided.

Patent document 1: Japanese Patent No. 3390725

DISCLOSURE OF THE INVENTION

Problems to be Solved by the Invention

Since the shape of the reduced diameter portion as described in the above Patent document 1 is a relatively simple oblique shape, a remarkable difference will not be caused between the desired shape and the actually formed shape. However, there was a case where the inclined angle (skewed angle) of the reduced diameter portion was large, for example, or a case where a difference of the formed amount, i.e., the amount of reduced diameter was large between the opposite ends separated by a plane including a longitudinal central axis, to result in enlarging a difference from the desired outer shape. In order to cancel this, it is required to increase the number of paths to be divided into small forming operations, which will result in prolonging a processing time (cycle time), so that there may be a case where it will become difficult to put them on a mass production line, depending on its outer shape to be employed as a forming target.

Therefore, it is an object of the present invention to provide a method and an apparatus for forming a changed diameter portion of a workpiece, to be capable of easily and rapidly forming the workpiece such as a tubular member to be provided with the changed diameter portion having a target outer shape.

Also, it is an object of the present invention to provide a method and an apparatus for forming a changed diameter portion of a workpiece, to be capable of forming the changed diameter portion having a target outer shape into a smooth surface.

Means for Solving the Problems

To solve the above-described problem, a method for forming a changed diameter portion of a workpiece according to the present invention is constituted by providing a plurality of target processed portions from an unprocessed portion of said workpiece up to a final target processed portion having a plurality of sections with axes inclined at least in a plane relative to a central axis of the unprocessed portion, providing a plurality of intermediate cross sections and center points thereof on the basis of said plurality of target processed portions, adjusting a relative position between each intermediate cross section of said workpiece and at least one roller revolving around said workpiece to perform a spinning process, between neighboring intermediate cross sections out of said plurality of intermediate cross sections, adjusting a revolution diameter of said roller at the center point of each intermediate cross section of said workpiece, adjusting an angle of a revolution plane of said roller to the central axis of said unprocessed portion at the center point of each intermediate cross section of said workpiece, to mate the center point, diameter and inclined angle of the revolution plane of said roller inside of a revolving locus of said roller, with the center point, diameter and inclined angle of each intermediate cross section of said workpiece, and driving said roller and said workpiece relatively to each other, with a part of outer peripheral surface of said roller being always in contact with an outer peripheral surface of said workpiece, to perform the spinning process to change the diameter of the portion to be processed of said workpiece, to form said portion to be processed into the shape of said final target processed portion.

In the method for forming the changed diameter portion of the workpiece as described above, for example, said roller may be driven along a line segment connecting the center points of said neighboring intermediate cross sections, and driven in a direction perpendicular to the driven direction, whereby the relative position between said roller and each intermediate cross section of said workpiece can be adjusted. Also, said workpiece may be swung in said plane, so that the angle of the revolution plane of said roller to the central axis of said unprocessed portion at the center point of each intermediate cross section of said workpiece can be adjusted. And, said roller may be driven to be close to and remote from the center point of each intermediate cross section of said workpiece, so that the revolution diameter of said roller at the center point of each intermediate cross section of said workpiece can be adjusted.

In the method for forming the changed diameter portion of the workpiece as described above, said roller may be driven toward the center point of said revolution plane, with said roller being driven to one end of said workpiece, to reduce the diameter of the portion to be processed of said workpiece to form a first tapered portion, and thereafter said roller may be driven toward the other end of said workpiece, with said roller being held to be in contact with said first tapered portion, to smooth outer surface of said first tapered portion.

In the method for forming the changed diameter portion of the workpiece as described above, said roller may be driven toward the center point of said revolution plane, with said roller being driven to one end of said workpiece, to reduce the diameter of the portion to be processed of said workpiece to form a first tapered portion, and thereafter said roller may be driven further toward the one end of said workpiece, with said roller being held to be in contact with said first tapered portion, to form an extended portion extending toward the one end of said workpiece continuously with said first tapered portion, and wherein said roller may be further driven toward the center point of said revolution plane, with said roller being driven to the other end of said workpiece, to reduce the diameter of the portion to be processed of said workpiece up to said first tapered portion to form a second tapered portion continuously with said first tapered portion. Furthermore, said roller may be driven toward the other end of said workpiece, with said roller being held to be in contact with said extended portion, and said roller may be driven to move in contact with the portion to be processed of said workpiece in a state maintaining the revolution diameter of said roller, until said roller will reach a portion to be processed with said second tapered portion.

And, an apparatus for forming a changed diameter portion of a workpiece according to the present invention comprises at least one roller for providing a plurality of target processed portions from an unprocessed portion of said workpiece up to a final target processed portion having a plurality of sections with axes inclined at least in a plane relative to a central axis of the unprocessed portion, providing a plurality of intermediate cross sections and center points thereof on the basis of said plurality of target processed portions, to revolve around said workpiece to perform a spinning process, relative position adjusting means for adjusting a relative position between said roller and each intermediate cross section of said workpiece, between neighboring intermediate cross sections out of said plurality of intermediate cross sections, roller operating means for adjusting a revolution diameter of said roller at the center point of each intermediate cross section of said workpiece, and angle adjusting means for adjusting an angle of a revolution plane of said roller to the central axis of said unprocessed portion at the center point of each intermediate cross section of said workpiece, and it is so constituted that said angle adjusting means, said relative position adjusting means and said roller operating means are controlled simultaneously to mate the center point, diameter and inclined angle of the revolution plane of said roller inside of a revolving locus of said roller, with the center point, diameter and angle of each intermediate cross section of said workpiece, and controlled to drive said roller and said workpiece relatively to each other, with a part of outer peripheral surface of said roller being always in contact with an outer peripheral surface of said workpiece.

In the apparatus for forming the changed diameter portion of the workpiece as described above, said relative position adjusting means may comprise a roller driving mechanism for driving said roller along a line segment connecting the center points of said neighboring intermediate cross sections, and a workpiece driving mechanism for driving said workpiece in a direction perpendicular to the direction of said roller driven by said roller driving mechanism, and may be constituted to control said roller driving mechanism and said workpiece driving mechanism simultaneously to adjust the relative position between said roller and each intermediate cross section of said workpiece.

In the apparatus for forming the changed diameter portion of the workpiece as described above, it may further comprise a roller operating mechanism for adjusting a revolution diameter of said roller at the center point of each intermediate cross section of said workpiece, and a clamp mechanism for holding said workpiece to be capable of swinging, and relatively adjusting the angle of the revolution plane of said workpiece to the central axis of said unprocessed portion at the center point of each intermediate cross section of said workpiece, and it may be so constituted that at least four mechanisms including said clamp mechanism, said roller operating mechanism, said workpiece driving mechanism and said roller driving mechanism are controlled simultaneously to mate the center point, diameter and inclined angle of the revolution plane of said roller inside of a revolving locus of said roller, with the center point, diameter and inclined angle of each intermediate cross section of said workpiece, and controlled to drive said roller and said workpiece relatively to each other, with a part of outer peripheral surface of said roller being always in contact with an outer peripheral surface of said workpiece.

On the other hand, as for the method for forming the changed diameter portion of the workpiece according to the present invention, it may be constituted by providing a plurality of target processed portions from an unprocessed portion of said workpiece up to a final target processed portion having a plurality of sections with axes inclined at least in a plane relative to a central axis of the unprocessed portion, providing a plurality of intermediate cross sections and center points thereof on the basis of said plurality of target processed portions, providing forming target axes connecting the center points of said neighboring intermediate cross sections out of said plurality of target processed portions, supporting said workpiece to place each forming target axis to begin with forming consecutively out of said forming target axes, in substantially the same axis as the central axis of the portion to be processed of said workpiece, mating the central axis of the portion to be processed of said workpiece with each forming target axis, and adjusting a revolution center of at least one roller in contact with an outer surface of said workpiece for performing a spinning process, and an angle of the revolution plane of said roller to the central axis of said unprocessed portion simultaneously, to perform the spinning process to change the diameter of said portion to be processed in each forming target axis, to form said portion to be processed into the shape of said final target processed portion.

In the method for forming the changed diameter portion of the workpiece as described above, said spinning process may be performed by driving at least one roller and said workpiece to be rotated relatively each other about said each forming target axis, and driving said at least one roller in a radial direction relative to said each forming target axis to be in contact with the outer surface of said portion to be processed, to mate the central axis of said portion to be processed with said each forming target axis, and change the diameter of said portion to be processed in said each forming target axis. Furthermore, the outer surface of said at least one roller may be maintained to be in contact with the outer surface of said portion to be processed, from beginning the spinning process to said workpiece until said workpiece is formed into the shape of said final target processed portion.

EFFECTS OF THE INVENTION

As the present invention is constituted as described above, the following effects can be achieved. That is, according to the method for forming the changed diameter portion of the workpiece as described above, a changed diameter portion having a target outer shape can be easily and rapidly provided to the workpiece such as a tubular member. Especially, since accuracy of shape of the changed diameter portion after the process is good, the number of paths can be reduced comparing with the prior art. According to a synergistic effect of reduction in processing time by reducing the number of paths and reduction in processing time by maintaining the roller to be always in contact with the workpiece, the processing time can be largely reduced comparing with the prior art.

Particularly, according to the method as described above for forming the first tapered portion and smoothing its outer surface, as a so-called "smoothing" is performed, the tapered portion served as the reduced diameter portion is smoothed, to form a smooth outer surface, so that a further appropriate changed diameter portion can be formed. And, according to the method as described above for forming the first tapered portion, extended portion and second tapered portion, as a so-called "extending" is performed, the extended portion is formed, and as a so-called "returning" is performed, it contributes to increasing a wall thickness of the extended portion, so that a consecutive first and second tapered portions can be formed at a good accuracy. Furthermore, according to the aforementioned method for moving the roller in contact with the portion to be processed of the workpiece in a state maintaining the revolution diameter of the roller, as the so-called "extending" is performed, the processing time can be reduced furthermore.

And, according to the aforementioned apparatus, the changed diameter portion having the target outer shape can be easily and rapidly provided to the workpiece such as the tubular member, without largely changing the basic structure of the prior apparatus. Especially, since accuracy of shape of the changed diameter portion after the process is good, the number of paths can be reduced comparing with the prior art. According to the synergistic effect of reduction in processing time by reducing the number of paths and reduction in processing time by maintaining the roller to be always in contact with the workpiece, the processing time can be largely reduced comparing with the prior art. And, by use of a conventional workpiece driving mechanism and roller driving mechanism, the relative position between the roller and each intermediate cross section of the workpiece can be adjusted easily and appropriately. Furthermore, according to the aforementioned apparatus for controlling the four mechanisms simultaneously, a four-axis cooperative control can be achieved appropriately.

Also, according to the aforementioned method for forming the changed diameter portion of the workpiece with the forming target axis being provided, the changed diameter portion having the target outer shape can be easily and rapidly provided to the workpiece such as the tubular member. Especially, since accuracy of shape of the formed changed diameter portion is good, the number of paths can be reduced comparing with the prior art. According to the synergistic effect of reduction in processing time by reducing the number of paths and reduction in processing time by maintaining the roller to be always in contact with the workpiece, the processing time can be largely reduced comparing with the prior art.

DESCRIPTION OF CHARACTERS

1 roller operating mechanism,
2 roller driving mechanism,
3 workpiece driving mechanism,
4 clamp mechanism,
5 tubular member,
11,12 roller,
W workpiece
CT controller

BEST MODE FOR CARRYING OUT THE INVENTION

Figure 1:
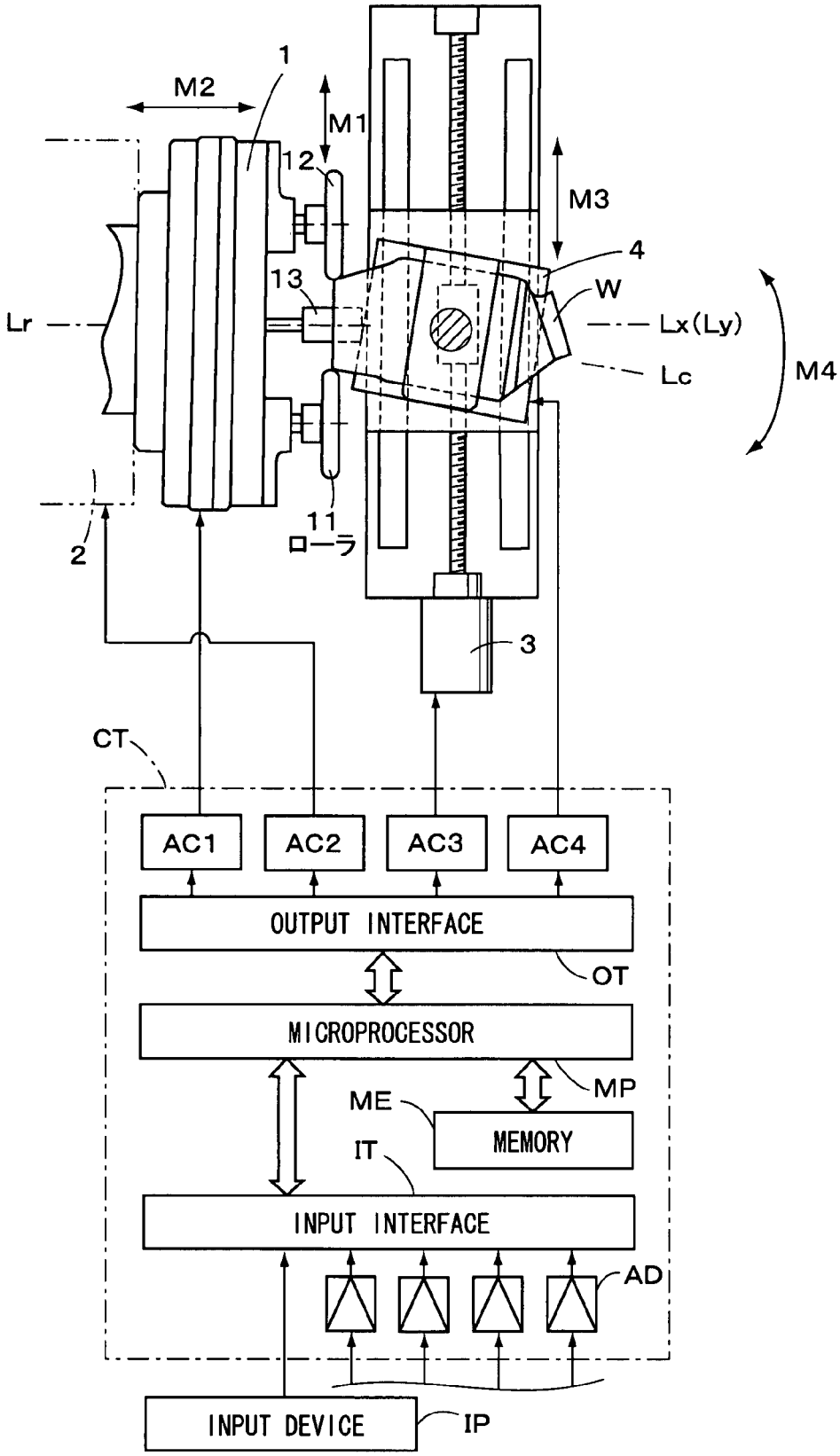
FIG. 1 is a block diagram showing a part of a spinning apparatus and constitution of a controller for use in an embodiment of the present invention.

Hereinafter, will be explained a desirable embodiment of the present invention, referring to drawings. FIG. 1 shows a part of a spinning apparatus for use in an embodiment of the present invention. Since its fundamental mechanical structure is similar to the structure as described in the aforementioned patent document 1, a four-axis cooperative control mechanism specialized in the present invention will be explained, referring to FIGS. 2-4, as well. In the present embodiment, a tubular member is employed as a workpiece to be processed, and an end portion forming apparatus for forming a reduced diameter portion on the end portion of the tubular member is constituted as an apparatus for forming a changed diameter portion on a workpiece. Finished products of the present embodiment are used for an outer shell (not shown) of a muffler for an automobile, a catalytic converter, and various pressure cases, for example. The workpiece to be processed according to the present embodiment is a stainless steel tube, while it is not limited to this, and may be employed other metallic tubes.

In FIG. 1, there is provided a roller open/close operating mechanism 1 for driving a pair of rollers 11 and 12 toward the center point of a workpiece W to be processed (intermediate cross section, as described later) to be close to or remote from it. It is so constituted that the roller operating mechanism 1 adjusts revolution diameters of the rollers 11 and 12 at the center point of the cross section to be processed of the workpiece W. And, it is so constituted that the rollers 11 and 12 (together with the roller operating mechanism 1) revolve about the center point of the cross section to be processed of the workpiece W, (thereby to provide a revolution plane), and rotate, being in contact with the workpiece W. Also, there are provided with a roller driving mechanism 2 for driving the rollers along a line segment connecting the center points of the neighboring cross sections to be processed, and a workpiece driving mechanism 3 for driving the workpiece W in a direction perpendicular to the direction of the rollers 11 and 12 driven by the roller driving mechanism 2, and it is so constituted that these driving mechanisms adjust the relative positions between the rollers 11 and 12 and each intermediate cross section. And, there is provided with a clamp mechanism 4 for holding the workpiece W, and by swinging the clamp mechanism 4 in a plane, it is so constituted to adjust the angle of the revolution plane of the workpiece W to the central axis (Lc) of the unprocessed portion (body portion) at the center point of each intermediate cross section of the workpiece. In this case, "Lr" indicates a moving direction of the roller driving mechanism 2, and "Lx" and "Ly" are forming target axes as described later with reference to FIG. 5.

Accordingly, the rollers 11 and 12 are driven by the roller operating mechanism 1 to be close to (move toward M1) and remote from the center of a mandrel 13, to perform a so called roller open/close operation. Also, the rollers 11 and 12 are driven by the roller driving mechanism 2 to move forward and backward (move toward M2) along the axis Lr, with the rollers 11 and 12 being revolved. On the other hand, the workpiece W is driven by a workpiece driving mechanism 3 to move in a direction perpendicular to the axis Lr (toward M3), to adjust the central coordinate of the revolution, and swung by a clamp mechanism 4, to adjust the angle of the revolution plane. As for the swinging center of the clamp mechanism 4 is not necessarily placed on the central axis (Lc), but may be placed on a plane including the central axis (Lc). Thus, according to the present embodiment, by means of the above each driving mechanism, four axes (rollers' open/close operation, rollers' back and forth movement, coordinate of the revolution center, and angle of the revolution plane) are controlled simultaneously to perform a process of one path (cooperative control).

As for the above rollers 11 and 12, the apparatus is not necessarily provided with a plurality of rollers, instead, it may be provided with one. However, it is preferable to provide a plurality of rollers, so as to reduce intermittent impacts, and it is ideal to provide two rollers 11 and 12 as in the present embodiment, or three rollers to be placed with an even space defined between them. Also, any moving course may be traced by the rollers 11 and 12 as long as they can be displaced in a radial direction. As for the roller operating mechanism 1, it can be constituted by a conventional planetary gear mechanism, or may be constituted in the same manner as described in the Patent document 1.

The each driving mechanism as described above is electrically connected to a controller CT in FIG. 1, from which control signals are output to each driving mechanism to control them numerically. The controller CT is provided with a microprocessor MP, memory ME, input interface IT and output interface OT, which are connected with each other through a bass bar, as shown in FIG. 1. The microprocessor MP is constituted to execute a program for spinning process according to the present embodiment, and the memory ME is constituted to memorize the program and temporarily memorize variable data required to execute the program.

An input device IP is provided to input initial conditions, operating conditions or the like of each driving mechanism into the microprocessor MP, e.g., by operating a key board or the like manually, and it is connected to an input interface IT. Also, there are provided various sensors (not shown), depending on their necessity, and signals detected by those sensors are fed to the controller CT, wherein the signals are input from the input interface IT to the microprocessor MP through amplifying circuits AD or the like. On the other hand, the control signals are output from the output interface OT and fed into each driving mechanism through driving circuits AC1 or the like. Instead of the controller CT, a control circuit may be provided for each driving mechanism to perform a predetermined individual control, respectively. In the controller CT, may be installed a system (described in Japanese Patent Laid-open Publication No. 2001-344009) for counting number of processes operated by the present apparatus and transmitting it to a communication infrastructure. Consequently, even in the case where the aforementioned prior spinning process and the manufacturing process of the present invention are selectively performed by the same apparatus, each number of operations can be obtained separately. In order to obtain the number, it may be so constituted to observe operating states of a plurality number of programs. And, in addition to it, if it is so constituted to mechanically detect the swinging motion of the workpiece during the spinning process and the continuing contact between the rollers and the workpiece, which will be necessarily caused when the present invention is executed, it can be obtained more certainly.

Figure 2:
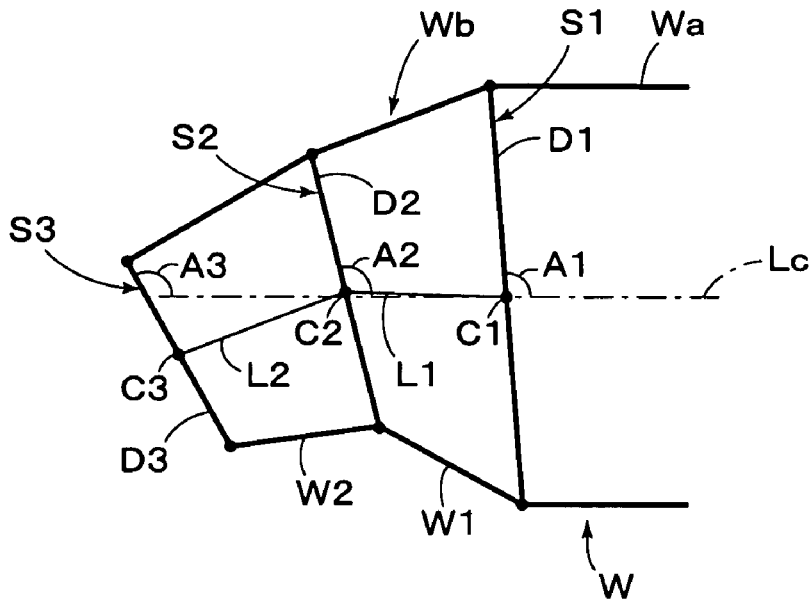
FIG. 2 is an explanatory figure showing an example of processing an end portion of a workpiece to reduce a diameter thereof by a spinning apparatus for use in an embodiment of the present invention.
Figure 3:
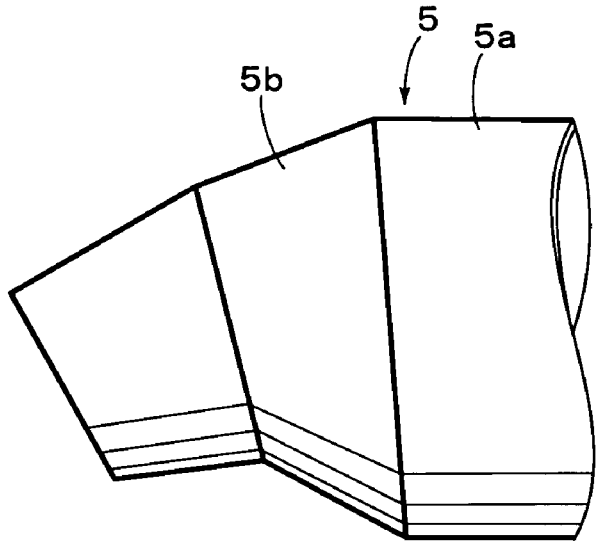
FIG. 3 is a front view of a part of a finished product reduced in diameter by a spinning apparatus for use in an embodiment of the present invention.

An example of the spinning process performed to an end portion of the tubular member by the above spinning apparatus, will be explained with reference to FIGS. 2-4. The thick solid line in FIGS. 2 and 4 indicates an outer shape estimating a formed tubular member 5 as shown in FIG. 3, i.e., the shape of the last target processed end portion, and indicates a target outer shape of a main body portion (body potion) 5*a* and a reduced diameter portion 5*b*. In FIG. 2, a plurality of target processed portions W1, W2 are provided from an unprocessed portion Wa of the workpiece W up to a final target processed portion Wb (corresponding to the reduced diameter portion 5*b* in FIG. 3) having a plurality of sections with axes L1, L2 inclined at least in a plane relative to a central axis Lc of the unprocessed portion Wa. On the basis of those target processed portions W1, W2, a plurality of intermediate cross sections S1, S2, S3 and center points C1, C2, C3 of them are provided. In this respect, "a plurality of target processed portions" include the reduced diameter portion (tapered portion) formed in each path, and its end portion, which is a portion to disappear in the next path, whereas "a plurality of intermediate cross sections" correspond to cross sections (=S1, S2, S3) at beginning ends of the plurality of target processed portions. And, their center points (C1, C2, C3) correspond to "center points of the intermediate cross sections".

Accordingly, by means of the roller driving mechanism 2 and workpiece driving mechanism 3, the relative position between the rollers 11 and 12 and each intermediate cross section S1, S2, S3 of the workpiece W is adjusted, between neighboring intermediate cross sections out of the plurality of intermediate cross sections S1, S2, S3. And, by means of the roller operating mechanism 1, a revolution diameter of the roller at the center point of each intermediate cross section of the workpiece W. Then, by means of the clamp mechanism 4, angles (=A1, A2, A3) of the revolution planes of the rollers 11 and 12 to the central axis Lc of the unprocessed portion Wa at the center point C1, C2, C3 of each intermediate cross section of the workpiece W are adjusted, and each driving mechanism is controlled simultaneously to mate the center point, diameter and inclined angle of the revolution planes (not shown) of the rollers 11 and 12 inside of revolving loci of the rollers 11 and 12, with the center point, diameter and inclined angle of each intermediate cross section of the workpiece W. Consequently, the rollers 11 and 12 and the workpiece W are controlled to be driven relatively to each other, with a part of outer peripheral surfaces of the rollers 11 and 12 being always in contact with the outer peripheral surface of the workpiece W, to perform the spinning process so as to change the diameter of the portion to be processed of the workpiece W, and finally to form the reduced diameter portion 5*b* as shown in FIG. 3.

Figure 4:
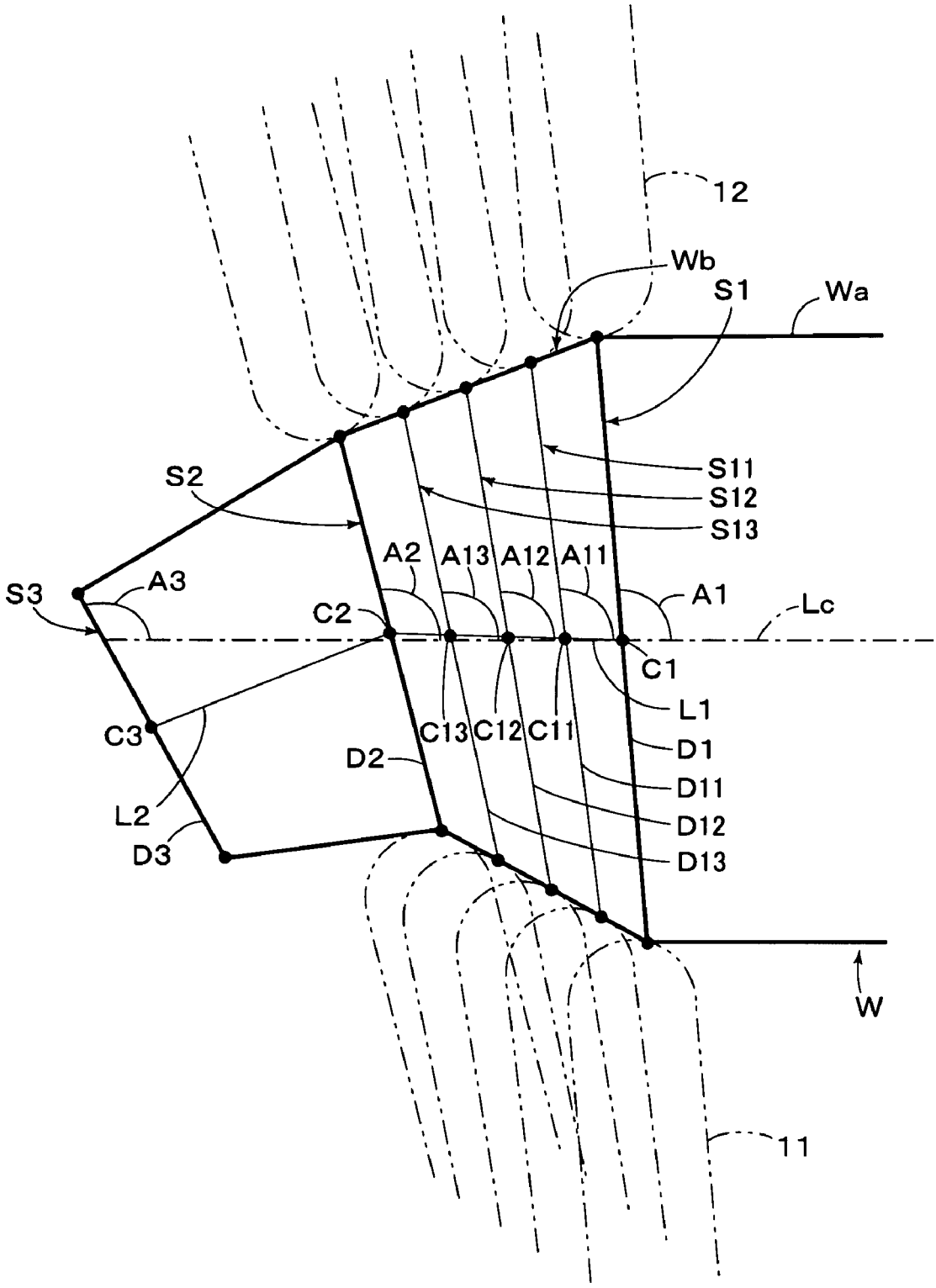
FIG. 4 is an explanatory figure showing an example of processing an end portion of a workpiece to reduce a diameter thereof by a spinning apparatus for use in an embodiment of the present invention.

Furthermore, as shown in FIG. 4, by dividing each intermediate cross section (e.g., S1) of the workpiece W into a plurality of intermediate cross sections (S11, S12, S13), each center point (C11, C12, C13), diameter (D11, D12, D13) and inclined angle (A11, A12, A13) are controlled to be mated with the center point, diameter and inclined angle of the revolution planes (not shown) of the rollers 11 and 12 inside of revolving loci of the rollers 11 and 12, thereby to more approximate to the final target processed portion Wb. In this case, it is important to always make fine adjustment (so called tool correction) to the coordinates of center points (C11, C12, C13) and inclined angles (A11, A12, A13) of the revolution planes of the rollers 11 and 12, so as to always contact the inside of the rollers 11 and 12 with the outer surface of the workpiece W. For example, in the vicinity of the intermediate cross section S2, it is important to estimate the revolution diameter and the inclined angle of revolution plane, such that the innermost sides of the rollers 11 and 12 will contact the workpiece W at a little bit right side thereof, without interfering with it. That is, the revolution centers of the rollers 11 and 12 are not necessarily required to move along the lines L1 and L2. Rather, the importance should be attached to such a control that the contacting points of the rollers 11 and 12 with the workpiece W are always to be placed on the outer peripheral surface of the final target processed portion Wb. Consequently, can be formed the reduced diameter portion 5*b* which approximates infinitely to a desired shape.

Figure 5:
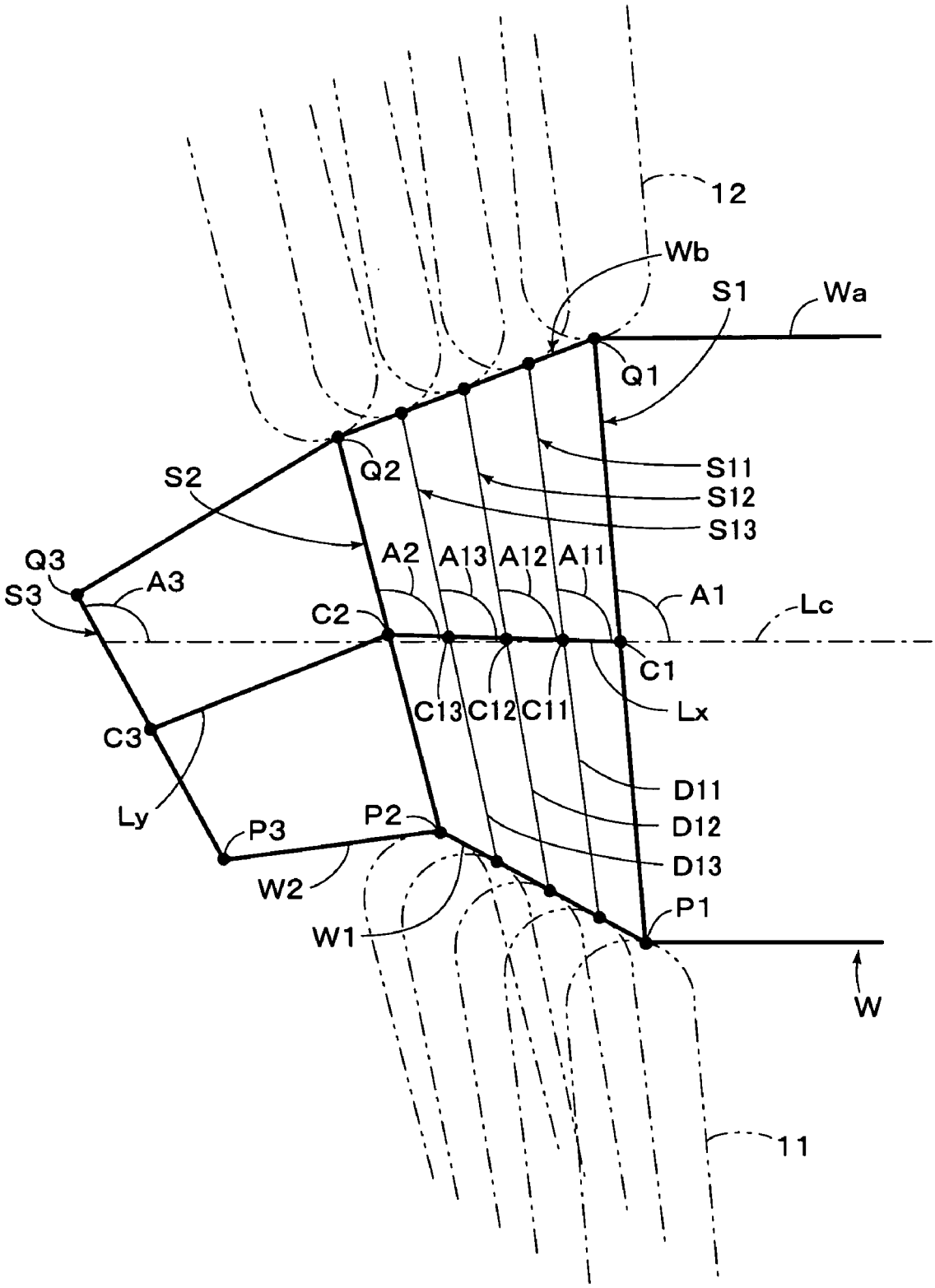
FIG. 5 is an explanatory figure showing another example of processing an end portion of a workpiece to reduce a diameter thereof by a spinning apparatus for use in an embodiment of the present invention.

Next, another example of the spinning process performed to an end portion of the tubular member by the spinning apparatus in FIG. 1, will be explained with reference to FIG. 5. The thick solid line segments Lx and Ly in FIG. 5 are not those indicative of the normal lines to the intermediate cross sections S1 and S2. They are the line segment (Lx) connecting the center points C1 and C2 of the neighboring intermediate cross sections S1 and S2, and the line segment (Ly) connecting the center points C2 and C3 of the neighboring intermediate cross sections S2 and S3, and these line segments constitute the forming target axis. Other references indicated in FIG. 5 are the same as those indicated in FIG. 4. In FIG. 5, a plurality of target processed portions W1, W2 are provided from the unprocessed portion Wa of the workpiece W up to the final target processed portion Wb having a plurality of sections with the axes (Lx and Ly) inclined at least in a plane relative to the central axis Lc of the unprocessed portion Wa. On the basis of those target processed portions W1, W2, a plurality of intermediate cross sections S1, S2, S3 and center points C1, C2, C3 of them are provided. Therefore, like in the example in FIG. 4, "a plurality of target processed portions" include the taper-like reduced diameter portion formed in each path, and its end portion, which is the portion to be disappeared in the next path, whereas "a plurality of intermediate cross sections" correspond to cross sections (e.g., S1, S2) at beginning ends of the plurality of target processed portions. And, their center points (C1, C2) correspond to "center points of the intermediate cross sections".

Accordingly, in FIG. 5, provided are the line segments Lx, Ly connecting the center points of the neighboring intermediate cross sections out of the plurality of intermediate cross sections S1, S2, S3. Then, the workpiece W is supported such that each forming target axis (e.g., Lx) served as the process beginning position consecutively is placed approximately on the same axis as and the (actual) central axis of the portion to be processed of the workpiece W. This is performed by means of the roller driving mechanism 2, workpiece driving mechanism 3 and clamp mechanism 4, together with the roller operating mechanism 1. By mating the central axis of the portion to be processed with each forming target axis (e.g., Lx), adjusting the revolution centers of the rollers 11 and 12, and the angles (revolution plane angles A1, A2, A3) of the revolution planes of the rollers 11 and 12 to the central axis Lc of the unprocessed portion Wa, simultaneously, to perform the spinning process so as to change the diameter of the portion to be processed on each forming target axis (e.g., Lx), and form the reduced diameter portion 5*b* as shown in FIG. 3.

Furthermore, as indicated by a thin line in FIG. 5, by dividing each intermediate cross section (e.g., S1) of the workpiece W into the plurality of intermediate cross sections (S11, S12, S13), and simultaneously controlling to provide appropriate diameter (=D11, D12, D13) and inclined angle (=A11, A12, A13) on each center point (C11, C12, C13), an approximately desired outer shape can be made. In this case, it is also important to always make the fine adjustment to the coordinates of center points (=C11, C12, C13) and inclined angles (=A11, A12, A13) of the revolution planes of the rollers 11 and 12, so as to always contact the inside of the rollers 11 and 12 with the outer surface of the workpiece W. For example, in the vicinity of the intermediate cross section S2, it is important to estimate the revolution diameter and the inclined angle of revolution plane, such that the innermost sides of the rollers 11 and 12 will contact the workpiece W at a little bit right side thereof, without interfering with it.

Next, referring to FIG. 5, will be explained the operation of the spinning process by means of the spinning apparatus as shown in FIG. 1. The portion including P1-P2 of the target processed portion of the workpiece W at a side thereof to be in contact with the roller 11, and the portion including Q1-Q2 at the side to be in contact with the roller 12 are provided for a first path, and before the spinning process, the clamp angle and central coordinate of the workpiece W are set to mate the forming target axis with the revolution axes of the rollers 11 and 12. That is, the center points (C1, C2) of each intermediate cross section S1, S2 are set. Next, the line segment (Lx) connecting the center points (C1, C2) is provided, while it is not the normal line. Likewise, the line segment (Ly) connecting the center points (C2, C3) is provided.

Then, the spinning process is performed basically by moving the revolving loci of the rollers 11 and 12 along the line segment (Lx), while the revolution diameter and the revolution plane angle are simultaneously adjusted, when the rollers 11 and 12 are moving. That is, by means of the roller operating mechanism 1, roller driving mechanism 2, workpiece driving mechanism 3 and clamp mechanism 4, four axes (rollers' open/close operation, rollers' back and forth movement, coordinate of the revolution center, and angle of the revolution plane) are adjusted simultaneously, and controlled to perform a process of one path (cooperative control). According to this process, since the last end of the forming target axes (Lx, Ly) correspond to the center points (C2, C3) of the intermediate cross sections of the next path, no gap will be caused between the paths, whereby any steps (described later) will not be formed on the outer surface of the reduced diameter processed portion.

In the above spinning process, the rollers 11 and 12 are driven to adjust their revolution axes to be positioned on the line segment (Lx), such that the contacting points of the rollers 11 and 12 with the workpiece W will draw the outer peripheral surface including P1-P2 and Q1-Q2 as the desired outer shape. Also, the inclined angle of the revolution plane (revolution plane angle) and the coordinate of the revolution center are simultaneously adjusted. In this case, in order to give a priority to such a condition that the contacting points of the rollers 11 and 12 with the workpiece W are positioned on the outer peripheral surface including P1-P2 and Q1-Q2, the line segment (Lx) is used as a reference line, while the revolution centers may not be positioned on the line segment (Lx) temporarily, to give the priority to the outer shape to be formed. Furthermore, as indicated by the thin line in FIG. 5, by dividing each intermediate cross section (e.g., S1) of the workpiece W into the plurality of intermediate cross sections (S11, S12, S13), and simultaneously controlling to provide appropriate revolution diameter (=D11, D12, D13) and revolution plane angle (=A11, A12, A13) on the center point (C11, C12, C13) of each intermediate cross section, an approximately desired outer shape can be made.

In the actual spinning process, if the coordinate and angle (to the axis Lc of the workpiece W) of the intermediate cross section S1 as the spinning process beginning information and the coordinate and angle (to the axis Lc of the workpiece W) of the intermediate cross section S2 as the spinning process terminating information are fed into the numerical control (NC) apparatus, and if it is set that the contacting points of the rollers 11 and 12 with the workpiece W will trace the outer peripheral surface including P1-P2 and Q1-Q2, then, necessary number of the intermediate points are provided by the NC apparatus, and those coordinates and angles are calculated automatically, to achieve interpolation appropriately.

Also, in the actual spinning process, a reduced diameter motion (restricted portion) is formed at the end of the tapered portion (e.g., Wb). That is, by moving the rollers 11 and 21 in the direction for reducing the diameter (called as "radial feeding"), the tapered portion is formed on the workpiece W, and on its end portion, the reducing diameter process is performed consecutively after having formed the tapered portion (with the same diameter), to form the extended portion (called as "extending"). This extended portion is the portion to be formed into the tapered portion in the next path, where it can be formed into any shape, with the rollers 11 and 12 being maintained to be in contact with the workpiece W without retracting the rollers 11 and 12. Therefore, its cycle time can be largely reduced, comparing with the prior art.

Furthermore, if such a process (called as "returning") for tracing the extended portion backward by the rollers 11 and 12, or such a process (called as "smoothing") for tracing the radial feeding applied portion backward after the extending process, the "returning" will contribute to increasing the wall thickness of the extended potion, and the "smoothing" will contribute to smoothing the tapered potion, whereby more appropriate processed portion can be formed. In the "returning" and "smoothing", the coordinate control for the revolution centers of the rollers 11 and 12, and angle control for the revolution plane may be applied properly, like in the "radial feeding" and "extending". Consequently, the radial feeding applied portion, i.e., tapered portion, will be made very high in accuracy of shape, and its repetition can provide the approximately desired shape for the processed portion. Particularly, not only any step will not be formed on the surface of the tapered portion, but also roller streaks will not be noticeable, to provide a microscopically smooth surface. This means superiority in smoothness and uniformity of material flow, and even superiority in intensity. In other words, by analyzing the material flow or streaks made by the spinning process, which shall be necessarily caused when the present invention is exploited, it can be definitely determined whether a product has been produced by the manufacturing method according to the present invention, or not.

In addition, with the processed portion being improved in accuracy of shape, it is not required to increase the number of paths as required in the prior art, instead, the number of paths can be reduced. Therefore, according to the synergistic effect of reduction in processing time by reducing the number of paths and reduction in processing time by maintaining the rollers 11 and 12 to be always in contact with the workpiece W, the cycle time can be largely reduced comparing with the prior art. In the case where the oblique reduced diameter portions are formed on the opposite ends of the workpiece W by the spinning process, for example, the cycle time can be reduced by 20-30%, comparing with the prior art (e.g., method of Patent document 1).

Figure 6:
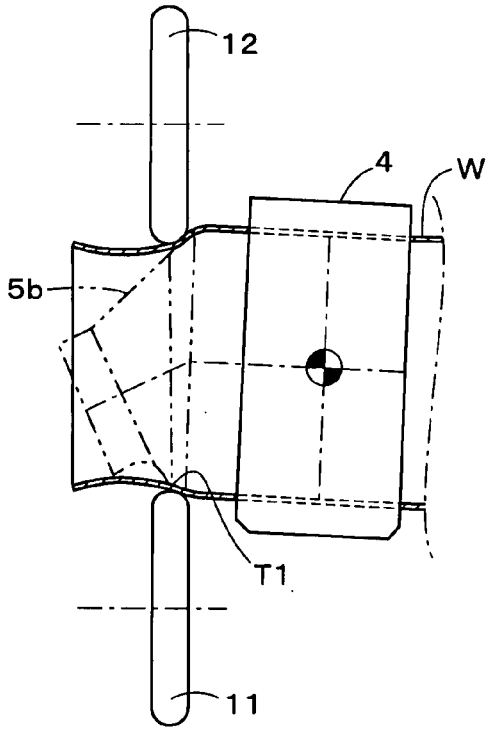
FIG. 6 is a cross sectional view showing a beginning state of the second path in case of processing an end portion of a workpiece to reduce a diameter thereof by a spinning apparatus for use in an embodiment of the present invention.
Figure 7:
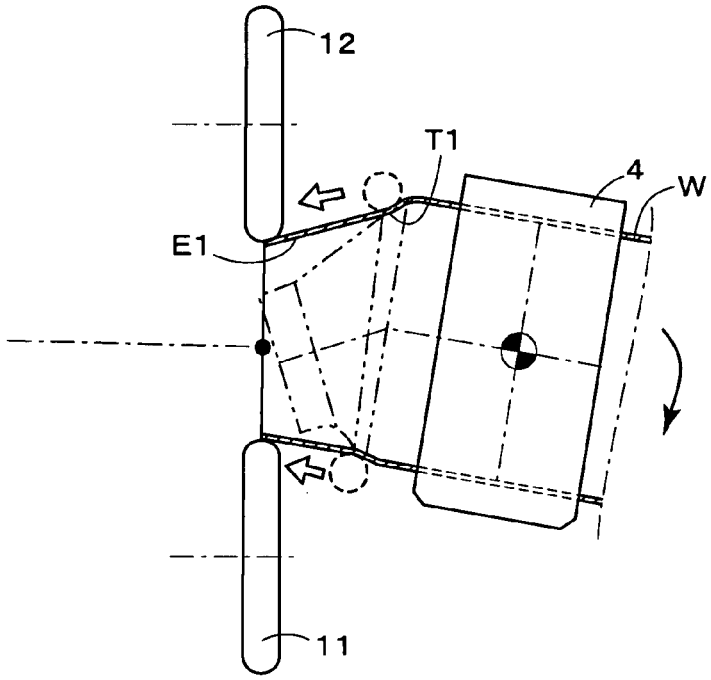
FIG. 7 is a cross sectional view showing a state of an extending process in case of processing an end portion of a workpiece to reduce a diameter thereof by a spinning apparatus for use in an embodiment of the present invention.

FIGS. 6-10 show each process formed in the second path. In FIG. 6, a first tapered portion T1 is the tapered portion formed in the first path, from which the spinning process in the second path begins. According to the process in FIG. 7, the rollers 11 and 12 are driven leftward from the left end of the first tapered portion T1, to form an extended portion E1 in a different tapered shape. In this process, the reducing diameter process by means of the rollers 11 and 12 is performed from the left end of the first tapered portion T1 (process beginning point as indicated by a phantom circle in FIG. 7) up to the extending process terminating point (positions of the rollers 11 and 12 as shown in FIG. 7). In this case, the workpiece W is controlled to be tilted by swinging motion of the clamp mechanism 4. And, with movement of the central coordinate caused by tilting the workpiece W being adjusted by means of the roller driving mechanism 2 and workpiece driving mechanism 3, the rollers 11 and 12 are driven toward the center point of the intermediate cross section of the workpiece W by the roller operating mechanism 1. Thus, with the roller operating mechanism 1, roller driving mechanism 2, workpiece driving mechanism 3 and clamp mechanism 4 being driven simultaneously, the four-axis cooperative control can be achieved.

The shape of the extended portion E1 is set to be such a shape that the operation in the next returning process can be performed effectively, and such a shape that the rollers 11 and 12 can be maintained to be in contact with the workpiece W. That is, according to the returning process in FIG. 8, the rollers 11 and 12 are driven rightward from the left to form a second tapered portion T2. In order to prepare for forming the second tapered portion T2, the process in FIG. 7 is set to be terminated at the inclined angle of the end face of beginning the process (left end of the second tapered portion T2). Therefore, such a waiting process is not required that the rollers 11 and 12 are placed away from the workpiece W at the end of the first forming path, to keep the clamp mechanism 4 swinging until it reaches the inclined angle of the workpiece W at the beginning end of the second path, thereafter the roller operating mechanism 1 is driven to contact the rollers 11 and 12 with the workpiece W.

Figure 8:
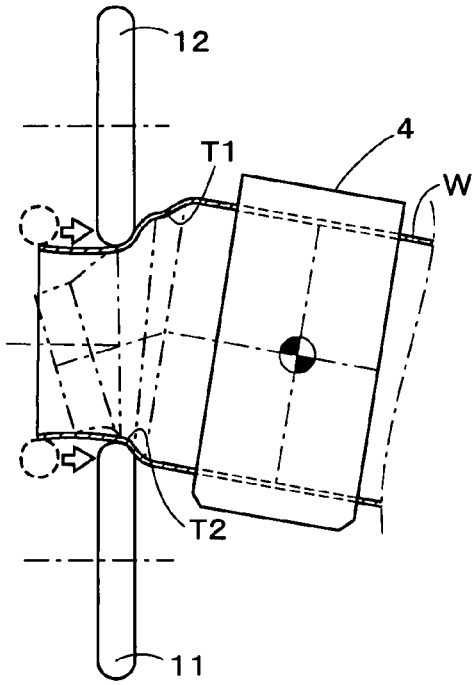
FIG. 8 is a cross sectional view showing a state of a returning process in case of processing an end portion of a workpiece to reduce a diameter thereof by a spinning apparatus for use in an embodiment of the present invention.

Accordingly, since the workpiece W is inclined at the extending process in FIG. 7, up to provide the inclined angle at the beginning end of the returning process in FIG. 8, the rollers 11 and 12 are not required to be away from the workpiece W at the process in FIG. 8, whereby the processing time can be largely reduced. In this case, since the extended portion E1 will be re-formed at the later process, any shape can be formed in the extending process in FIG. 7. Then, the workpiece W is fixed at the inclined angle provided at the end of the extending process in FIG. 7, and reduced in diameter by the rollers 11 and 12, which will be driven up to the position at the beginning end for forming the second tapered portion T2. At this time, the extended portion E1, which was extended at the extending process in FIG. 7 to be decreased in wall thickness, is increased in wall thickness (recovered) at the returning process in FIG. 8.

Figure 9:
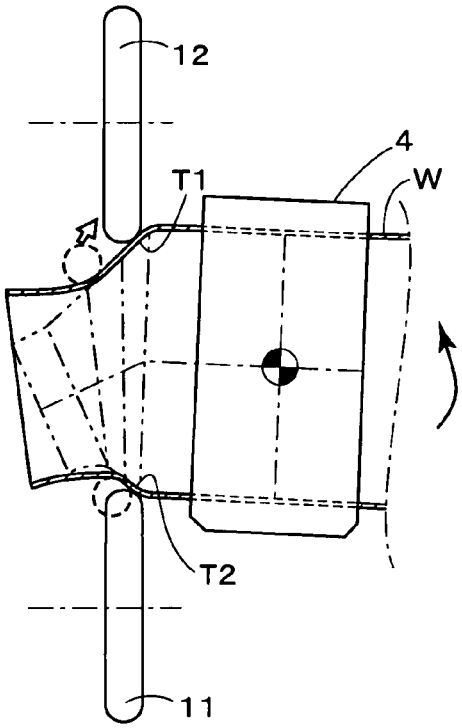
FIG. 9 is a cross sectional view showing a state of a radial feeding process in a reverse direction, in case of processing an end portion of a workpiece to reduce a diameter thereof by a spinning apparatus for use in an embodiment of the present invention.

Next, is performed the radial feeding process in FIG. 9, where "radial feeding" is performed to form the tapered portion. The rollers 11 and 12 are driven from the beginning end (left end) for forming the second tapered portion T2 up to its terminating end (right end), to form the second tapered portion T2. That is, the reducing diameter process by means of the rollers 11 and 12 is performed from the left end face of the second tapered portion T2 (process beginning point as indicated by a phantom circle in FIG. 9) up to the radial feeding terminating point (positions of the rollers 11 and 12 as shown in FIG. 9). In this case, with the roller operating mechanism 1, roller driving mechanism 2, workpiece driving mechanism 3 and clamp mechanism 4 being driven simultaneously, the four-axis cooperative control can be achieved (in the direction opposite to that in FIG. 7). Thus, with the "radial feeding" being performed from the left toward the right in FIG. 9, the workpiece W is prevented from being decreased in wall thickness, as it is prevented from being increased in wall thickness (recover) in the returning process as described above.

Figure 10:
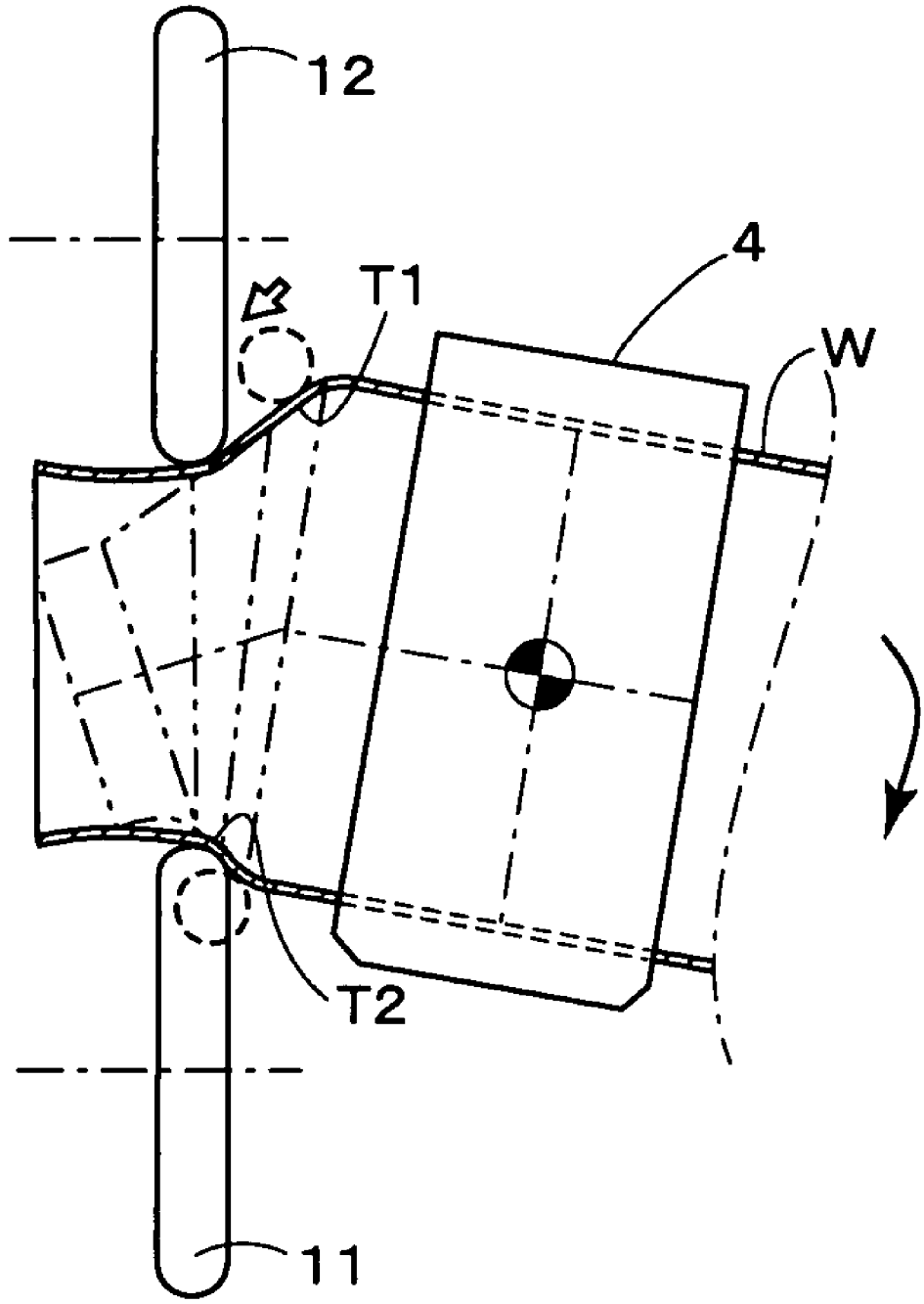
FIG. 10 is a cross sectional view showing a state of a smoothing process in case of processing an end portion of a workpiece to reduce a diameter thereof by a spinning apparatus for use in an embodiment of the present invention.

Then, performed is the smoothing process in FIG. 10, where the rollers 11 and 12 are driven from the terminating end toward the beginning end for forming the second tapered portion T2, along the same locus as that traced when it was formed, to perform the "smoothing", whereby the surface of the second tapered portion T2 is smoothed. The end of this process (the state where the rollers 11 and 12 are placed at the left end of the second tapered portion T2, as shown in FIG. 10) corresponds to the beginning of the next path, so that the state as shown in FIG. 10 corresponds to the state as shown in FIG. 6 in the next path.

According to the present embodiment, the paths constituted in the processes as shown in FIGS. 6-10 are repeated a plurality number of cycles, while the process in each path is not limited to those as described above, but any combination can be made within the scope of the present invention. For example, the "radial feeding" may be adapted to begin in the forward direction (reducing diameter direction), or the "smoothing" process may be omitted. Instead, the above-described paths may be repeated in the single path, or other process may be interrupted. It may be so constituted that the aforementioned four-axis cooperative control is to be performed in any process.

Figure 11:
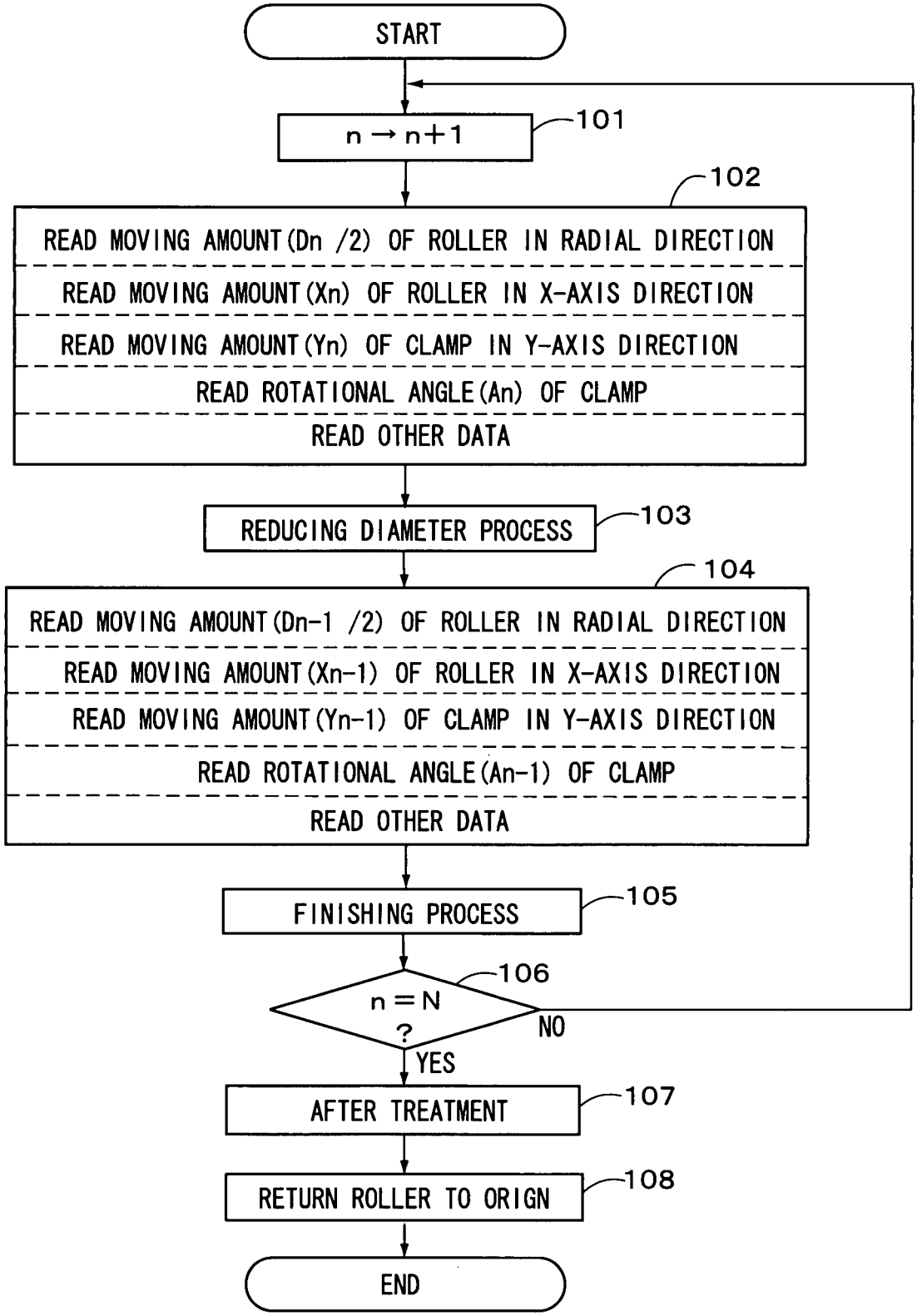
FIG. 11 is a flowchart showing an example of operation of a spinning apparatus for use in an embodiment of the present invention.

FIG. 11 is a flowchart showing an example of the aforementioned four-axis cooperative control, to show an example for performing a reducing diameter process including the radial feeding process in the opposite direction (i.e., forward direction) to that in FIG. 9, and a finishing process including the smoothing process in the opposite direction to that in FIG. 10. After a value (n) indicative of a forming position in each processing cycle is incremented at Step 101, the moving amount (Dn/2) of the rollers 11 and 12 in the radial direction, the moving amount (Xn) of the rollers 11 and 12 in the X-axis direction, the moving amount (Yn) of the clamp mechanism 4 in the Y-axis direction, the rotating angle (An) of the clamp mechanism 4, and other data relating to the spinning process are read from the memory ME in FIG. 1, at Step 102. In this respect, the X-axis direction provided for the rollers 11 and 12 corresponds to the lateral direction in FIG. 1, and the Y-axis direction provided for the clamp mechanism 4 corresponds to the vertical direction in FIG. 1. Based on those data, the roller operating mechanism 1, roller driving mechanism 2, workpiece driving mechanism 3 and clamp mechanism 4 are driven simultaneously at Step 103, to perform the four-axis cooperative control, whereby the workpiece W and the rollers 11 and 12 are relatively driven, and the rollers 11 and 12 are driven toward the center, with those being rotated, to perform the reducing diameter process, in the same manner as FIG. 9.

Next, at Step 104, there are provided for the position (n-1) retracted by one process in the reverse direction to the forming position (n), the moving amount (Dn-1/2) of the rollers 11 and 12 in the radial direction, the moving amount (Xn-1) of the rollers 11 and 12 in the X-axis direction, the moving amount (Yn-1) of the clamp mechanism 4 in the Y-axis direction, the rotating angle (An-1) of the clamp mechanism 4, and other data relating to the spinning process are read from the memory ME in FIG. 1. Then, it proceeds to Step 105, where the finishing process with the "smoothing" is performed by the four-axis cooperative control to the tapered portion (e.g., T1) of the workpiece W, from the position (n) to the position (n-1). Thus, the above process is repeated until it is determined to have reached a predetermined processing cycle (N) at Step 106. When the spinning process is terminated, a terminating process is performed (to clear various kinds of memorized data and so on) at Step 107, and the rollers 11 and 12 or the like will return to their original positions at Step 108.

In the mean time, while a so-called workpiece fixed type (non-rotating type) has been employed according to the embodiment, a workpiece rotating type (non-revolving rollers type) may be employed, or both of them may be combined. However, such an apparatus or control software for controlling a behavior of the workpiece W, while driving it to be rotated, shall be very complex, so that it is little worthy in practice. For example, it can be considered that a clamp capable of rotating the workpiece is mounted on a tip end of an articulated arm of a large (known) industrial robot, to insert the workpiece between a plurality of rollers not to be revolved (only open/close operation), and reduce the diameter of the workpiece, adjusting its behavior. However, the clamp mechanism and robot with a strength capable of enduring the reaction force caused at the time of the spinning process will be large in scale, with a large mass, so that it is not practical to control them to be driven. Therefore, it is preferable to select the forming system to be of the workpiece fixed type, and it is most appropriate to use the forming apparatus as disclosed in (FIG. 23) of the aforementioned patent.

Also, according to the present embodiment, the processed portion of the workpiece W is provided with a plurality of portions having oblique axes in a plane to the central axis Lc of the non-processed portion Wa, to provide a so-called oblique spinning process. Furthermore, this is also applicable to a so-called skewed spinning process, which forms a processed portion having a plurality of oblique axes in a plane, and provided with a plurality of portions oblique (curved) in three dimension. In this case, it is required to adjust the relative position between the rollers and the workpiece so as to place the central axis of the non-processed portion of the workpiece not to be in the same plane with the forming target axis, and not to be in the same axis as it, nor in parallel with it. For this purpose, five-axis cooperative control is required, to cause the apparatus and control software to be slightly complex.

Figure 12:
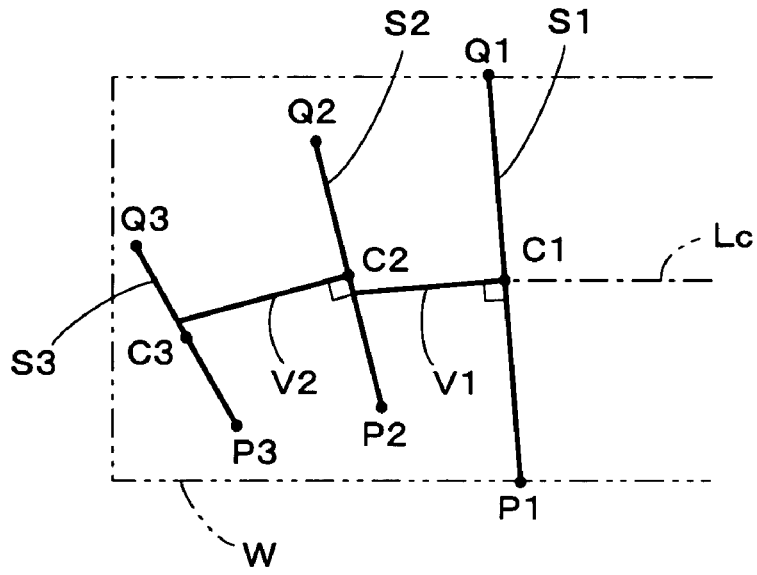
FIG. 12 is an explanatory figure showing an example of processing an end portion of a workpiece to reduce a diameter thereof by a prior spinning apparatus.
Figure 13:
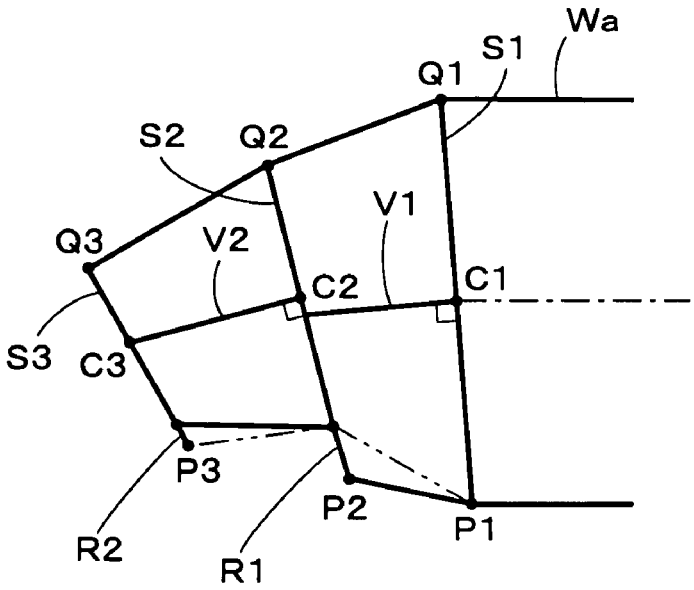
FIG. 13 is an explanatory figure showing an example of processing an end portion of a workpiece to reduce a diameter thereof by a prior spinning apparatus.

FIGS. 12 and 13 show a prior method drafted in the same manner as those in FIGS. 2 and 5 showing the present embodiment, to compare the method for forming the changed diameter portion of the workpiece as described in the aforementioned Patent document 1 with the method for forming the changed diameter portion of the workpiece of the present invention. FIG. 12 shows an oblique spinning process by means of two paths (two times of oblique reducing diameter process), and the formed target shape is the same as the tubular member 5 as shown in FIG. 3. In FIG. 12, by the spinning process of the first path, formed is a taper-like reduced diameter portion having cross sections S1-S3, which include each point of P1-P3 at a lower part in FIG. 12, and which include each point of Q1-Q3 at an upper part in FIG. 12. These cross sections S1-S3 are determined, considering a reducing diameter ratio, number of paths or the like as described in the Patent document 1, the cross section S1 and a normal line V1 extending from its center point C1 to the tip end are provided, so that the spinning process is performed, with the revolution center of a roller (not shown) being moved along the normal line V1. That is, although the coordinate of the center point C1 and the oblique angle of the cross section S1 (to the central axis Lc of the non-processed portion of the workpiece W) and the normal line from the center point C1 are provided, the clamp device (workpiece) will not be swung when the spinning process is being performed, (therefore, it will not be tilted), to be maintained in the fixed state. However, since each roller revolves along the same diameter locus, the tapered portion in rotation symmetry to the normal line V1 (and, the reduced diameter portion of the same diameter formed in front of it) always appears.

As a result, as shown in FIG. 13, provided that the upper Q1-Q2 is set as a reference (generatrix), formed is the tapered portion of rotation symmetry, with the normal line V1 being provided as its axis, and with Q1-Q2 being provided as its generatrix, and also formed at its lower part is the tapered portion of rotation symmetry, with Q1-Q2 being provided as its generatrix axis. Or, provided that the lower P1-P2 is set as the generatrix, formed at its upper part is the tapered portion of rotation symmetry, with P1-P2 being provided as its generatrix, as well (in this case, the generatrix is not limited to a straight line, but a curved line may result in the same). Thus, even if any reference was used, the tapered surface other than the generatrix will cause a difference to a desired outer shape (target shape). If the Q1-Q2 reference was used, for example, a step R1 would be formed at the lower part, whereas if the P1-P2 reference was used, similar difference would be caused at the upper part. Likewise in the second path, if the Q2-Q3 reference was used to perform the spinning process around the normal line V2, a step R2 will be formed against its forward portion (not shown). Therefore, it is required to correct the normal line V1 to provide a uniform difference so as to minimize the difference, or divide the first path into a plurality small paths, which will necessarily result in increase in processing time, to prolong the cycle time, and which might result in increase in manufacturing cost, depending upon the outer shape of the product.

Thus, according to the method for providing a plurality of target cross sections (e.g., S1 and S2) in the middle of the portion to be formed, and setting the normal lines (e.g., V1 and V2) with the center points (e.g., C1 and C2) provided for their beginning points, then moving the revolution centers of the rollers along the normal lines to perform the spinning process, only the outer shape of rotation symmetry with a specific generatrix can be made, there is a large possibility of causing the difference from the target shape. In contrast, according to the present invention, the reduced diameter portion approximately mated with the desired target shape can be formed appropriately and rapidly, as described before.

The method for forming the changed diameter portion of the workpiece by the spinning process according to the present embodiment may be so constituted to combine the process for forming the body portion 5*a* in FIG. 3 by a co-axial spinning process to the body portion of the workpiece W, with the process for forming the reduced diameter portion 5*b* in FIG. 3 by the spinning process to the end portion of the workpiece W, and performing these processes consecutively. For example, it may be so constituted to reduce the diameter of the workpiece W by the co-axial spinning process, for the initial several paths, then, from the intermediate path, to change into the spinning process to the aforementioned end portion. The sizing process to the body portion of the workpiece W can be performed by the same spinning apparatus (e.g., disclosed in Japanese Laid-open Publication No. 2001-107725) as the one for the spinning process applied to the end portion of the workpiece W. The clamp mechanism is not limited to a simple dividing (open/close) type, but may be used the one having variable diameter and centering function (e.g., disclosed in Japanese Laid-open Publication No. 2004-202531). Furthermore, the apparatus as disclosed in FIG. 16 of the aforementioned Patent document 1 may be provided integrally to be capable of indexing, and may be constituted to form the changed diameter portion including a skewed component tilted in the second plane, which is different from the aforementioned plane, to provide the indexing control as the fifth axis control.

The cross section of the end portion of the workpiece W is not limited to the circular cross section, but it can be formed into various shapes of oval, elongated circle (racetrack) or the like, also, the body portion of the workpiece W is not limited to the circle, oval, elongated circle or the like, and various shapes of approximately trapezoid, triangle, quadrangle or the like, so that the cross section of the catalytic converter is arbitrary. In this case, as shown in FIG. 28 of the aforementioned Patent document 1, when the end portion is enlarged in diameter to form the changed diameter portion, the method for forming the changed diameter portion of the present invention can be applied, to form a non-axial changed diameter portion in combination with being offset from, oblique to and skewed from the unprocessed portion. Furthermore, the method for forming the changed diameter portion according to the present invention is not limited to the catalytic converter. Not only it is applicable to automobile parts such as a diesel exhaust gas treatment device (diesel particulate filter), muffler or the like, but also it is applicable to production of other metallic containers.

The invention claimed is:

1. A method for forming a changed diameter portion of a workpiece, comprising:

providing a plurality of target processed portions from an unprocessed portion of said workpiece up to a final target processed portion having a plurality of sections with axes inclined at least in a plane relative to a central axis of the unprocessed portion;

providing a plurality of intermediate cross, sections and center points thereof on the basis of said plurality of target processed portions;

adjusting a relative position between each intermediate cross section of said workpiece and at least one roller revolving around said workpiece to perform a spinning process, in a moving process between neighboring intermediate cross sections out of said plurality of intermediate cross sections;

adjusting a revolution diameter of said roller at the center point of each intermediate cross section of said workpiece, in the moving process between neighboring intermediate cross sections out of said plurality of intermediate cross sections;

adjusting an angle of a revolution plane of said roller to the central axis of said unprocessed portion at the center point of each intermediate cross section of said workpiece, in the moving process between neighboring intermediate cross sections out of said plurality of intermediate cross sections, to mate the center point, diameter and inclined angle of the revolution plane of said roller inside of a revolving locus of said roller, with the center point, diameter and inclined angle of each intermediate cross section of said workpiece; and driving said roller and said workpiece relatively to each other, with a part of an outer peripheral surface of said roller being always in contact with an outer peripheral surface of said workpiece, to perform the spinning process to change the diameter of the portion to be processed of said workpiece, with the revolution diameter and the angle of the revolution plane of said roller being adjusted simultaneously in the relative motion between said roller and said workpiece, to form said portion to be processed into the shape of said final target processed portion.

2. A method for forming a changed diameter portion of a workpiece as set forth in claim 1, wherein said roller is driven along a line segment connecting the center points of said neighboring intermediate cross sections, and driven in a direction perpendicular to the driven direction, to adjust the relative position between said roller and each intermediate cross section of said workpiece.

3. A method for forming a changed diameter portion of a workpiece as set forth in claim 1, wherein said workpiece is swung in said plane, to adjust the angle of the revolution plane of said roller to the central axis of said unprocessed portion at the center point of each intermediate cross section of said workpiece.

4. A method for forming a changed diameter portion of a workpiece as set forth in claim 1, wherein said roller is driven to be close to and remote from the center point of each intermediate cross section of said workpiece, to adjust the revolution diameter of said roller at the center point of each intermediate cross section of said workpiece.

5. A method for forming a changed diameter portion of a workpiece as set forth in claim 1, wherein said roller is driven toward the center point of said revolution plane, with said roller being driven to one end of said workpiece, to reduce the diameter of the portion to be processed of said workpiece to form a first tapered portion, and thereafter said roller is driven toward the other end of said workpiece, with said roller being held to be in contact with said first tapered portion, to smooth outer surface of said first tapered portion.

6. A method for forming a changed diameter portion of a workpiece as set forth in claim 1, wherein said roller is driven toward the center point of said revolution plane, with said roller being driven to one end of said workpiece, to reduce the diameter of the portion to be processed of said workpiece to form a first tapered portion, and thereafter said roller is driven further toward the one end of said workpiece, with said roller being held to be in contact with said first tapered portion, to form an extended portion extending toward the one end of said workpiece continuously with said first tapered portion, and said roller is further driven toward the center point of said revolution plane, with said roller being driven to the other end of said workpiece, to reduce the diameter of the portion to be processed of said workpiece up to said first tapered portion to form a second tapered portion continuously with said first tapered portion.

7. A method for forming a changed diameter portion of a workpiece as set forth in claim 6, wherein said roller is driven toward the other end of said workpiece, with said roller being held to be in contact with said extended portion, and said roller is driven to move in contact with the portion to be processed of said workpiece in a state maintaining the revolution diameter of said roller, until said roller will reach a portion to be processed with said second tapered portion.

8. An apparatus for forming a changed diameter portion of a workpiece comprising:

at least one roller for providing a plurality of target processed portions from an unprocessed portion of said workpiece up to a final target processed portion having a plurality of sections with axes inclined at least in a plane relative to a central axis of the unprocessed portion, providing a plurality of intermediate cross sections and center points thereof on the basis of said plurality of target processed portions, to revolve around said workpiece to perform a spinning process;

relative position adjusting means for adjusting a relative position between said roller and each intermediate cross section of said workpiece, in a moving process between neighboring intermediate cross sections out of said plurality of intermediate cross sections;

roller operating means for adjusting a revolution diameter of said roller at the center point of each intermediate cross section of said workpiece, in the moving process between neighboring intermediate cross sections out of said plurality of intermediate cross sections; and angle adjusting means for adjusting an angle of a revolution plane of said roller to the central axis of said unprocessed portion at the center point of each intermediate cross section of said workpiece, in the moving process between neighboring intermediate cross sections out of said plurality of intermediate cross sections, and wherein said angle adjusting means, said relative position adjusting means and said roller operating means are controlled simultaneously to mate the center point, diameter and inclined angle of the revolution plane of said roller inside of a revolving locus of said roller, with the center point, diameter and angle of each intermediate cross section of said workpiece, and controlled to drive said roller and said workpiece relatively to each other, with a part of outer peripheral surface of said roller being always in contact with an outer peripheral surface of said workpiece.

9. An apparatus for forming a changed diameter portion of a workpiece as set forth in claim 8, wherein said relative position adjusting means comprises a roller driving mechanism for driving said roller along a line segment connecting the center points of said neighboring intermediate cross sections, and a workpiece driving mechanism for driving said workpiece in a direction perpendicular to the direction of said roller driven by said roller driving mechanism, and controls said roller driving mechanism and said workpiece driving mechanism simultaneously to adjust the relative position between said roller and each intermediate cross section of said workpiece.

10. An apparatus for forming a changed diameter portion of a workpiece as set forth in claim 9, further comprising a roller operating mechanism for adjusting a revolution diameter of said roller at the center point of each intermediate cross section of said workpiece, and a clamp mechanism for holding said workpiece to be capable of swinging, and relatively adjusting the angle of the revolution plane of said workpiece to the central axis of said unprocessed portion at the center point of each intermediate cross section of said workpiece, wherein at least four mechanisms including said clamp mechanism, said roller operating mechanism, said workpiece driving mechanism and said roller driving mechanism are controlled simultaneously to mate the center point, diameter and inclined angle of the revolution plane of said roller inside of a revolving locus of said roller, with the center point, diameter and inclined angle of each intermediate cross section of said workpiece, and controlled to drive said roller and said workpiece relatively to each other, with a part of outer peripheral surface of said roller being always in contact with an outer peripheral surface of said workpiece.

11. A method for forming a changed diameter portion of a workpiece, comprising:

providing a plurality of target processed portions from an unprocessed portion of said workpiece up to a final target processed portion having a plurality of sections with axes inclined at least in a plane relative to a central axis of the unprocessed portion;

providing a plurality of intermediate cross sections and center points thereof on the basis of said plurality of target processed portions;

providing forming target axes connecting the center points of said neighboring intermediate cross sections out of said plurality of target processed portions;

supporting said workpiece to place each forming target axis to begin with forming consecutively out of said forming target axes, in substantially the same axis as the central axis of the portion to be processed of said workpiece;

mating the central axis of the portion to be processed of said workpiece with each forming target axis; and adjusting a revolution center of at least one roller in the moving process between neighboring intermediate cross sections out of said plurality of intermediate cross sections, in contact with an outer surface of said workpiece for performing a spinning process, and an angle of the revolution plane of said roller in the moving process between neighboring intermediate cross sections out of said plurality of intermediate cross sections, to the central axis of said unprocessed portion simultaneously, to perform the spinning process to change the diameter of said portion to be processed in each forming target axis, to form said portion to be processed into the shape of said final target processed portion.

12. A method for forming a changed diameter portion of a workpiece as set forth in claim 11, wherein said spinning process is performed by driving at least one roller and said workpiece to be rotated relatively to each other about said each forming target axis, and driving said at least one roller in a radial direction relative to said each forming target axis to be in contact with the outer surface of said portion to be processed, to mate the central axis of said portion to be processed with said each forming target axis, and change the diameter of said portion to be processed in said each forming target axis.

13. A method for forming a changed diameter portion of a workpiece as set forth in claim 11, wherein the outer surface of said at least one roller is maintained to be in contact with the outer surface of said portion to be processed, from beginning the spinning process to said workpiece until said workpiece is formed into the shape of said final target processed portion.

* * * * *